US007235934B2

(12) United States Patent
Hung et al.

(10) Patent No.: US 7,235,934 B2
(45) Date of Patent: Jun. 26, 2007

(54) METHOD FOR CONTROLLING OPERATIONS OF A BACKLIGHT UNIT OF A LIQUID CRYSTAL DISPLAY

(75) Inventors: Hsin-Cheng Hung, Tainan County (TW); Ming-Ta Yang, Tainan County (TW)

(73) Assignee: Chi Mei Optoelectronics Corporation, Tainan County (TW)

( * ) Notice: Subject to any disclaimer, the term of this patent is extended or adjusted under 35 U.S.C. 154(b) by 190 days.

(21) Appl. No.: 11/160,236

(22) Filed: Jun. 15, 2005

(65) Prior Publication Data

US 2006/0007110 A1 Jan. 12, 2006

(30) Foreign Application Priority Data

Jun. 16, 2004 (TW) ..... 93117318 A

(51) Int. Cl.
*H01B 37/00* (2006.01)

(52) U.S. Cl. ..... 315/312; 345/102; 345/104; 345/92

(58) Field of Classification Search ..... 315/312; 345/102, 104, 82, 87, 89, 105
See application file for complete search history.

(56) References Cited

U.S. PATENT DOCUMENTS

| | | | | |
|---|---|---|---|---|
| 6,952,195 | B2 * | 10/2005 | Arakawa | 345/102 |
| 7,075,201 | B2 * | 7/2006 | Takahashi et al. | 310/68 D |
| 2004/0113631 | A1 * | 6/2004 | Hyeon-Yong | 324/510 |
| 2005/0083280 | A1 * | 4/2005 | Hiraki et al. | 345/87 |
| 2005/0146492 | A1 * | 7/2005 | Baba et al. | 345/87 |
| 2005/0231457 | A1 * | 10/2005 | Yamamoto et al. | 345/102 |

OTHER PUBLICATIONS

N. Fisekovic et al., Improved Motion-Picture Quality of AM-LCDs Using Scanning Backlight., Asia Display/IDW'01., pp. 1637-1640, Eindhoven, The Netherlands, no date.

* cited by examiner

*Primary Examiner*—Trinh Vo Dinh
(74) *Attorney, Agent, or Firm*—Winston Hsu

(57) ABSTRACT

A method for controlling operations of a backlight unit of a liquid crystal display (LCD) is disclosed. The LCD includes a LCD panel and the backlight unit. The LCD panel has a plurality of display units. The backlight unit is placed behind the LCD panel and has a plurality of illumination devices for providing light to the LCD panel. The method includes: (a) keeping at least two of the illumination devices turned on at all times; (b) turning off one of the illumination devices every predetermined time interval; and (c) turning on one of the illumination devices every predetermined time interval.

15 Claims, 9 Drawing Sheets

METHOD FOR CONTROLLING OPERATIONS OF A BACKLIGHT UNIT OF A LIQUID CRYSTAL DISPLAY

BACKGROUND OF THE INVENTION

1. Field of the Invention

The present invention relates to a method for controlling operations of a backlight unit of a liquid crystal display, and more particularly, to a method of reducing blurring of moving images by controlling the operations of the backlight unit.

2. Description of the Prior Art

A liquid crystal display (LCD) has advantages of being light weight, having a low power consumption, giving off low radiation and the ability to be applied to various portable electronic products such as notebook computers and personal digital assistants (PDAs). In addition, LCD monitors and LCD televisions are gaining popularity as a substitute for traditional cathode ray tube (CRT) monitors and televisions. However, due to their physical limitations, the liquid crystal molecules need to be constantly rotated and rearranged while image data is changed, which often causes a delay phenomenon. Consequently, the delay phenomenon becomes even worse when a liquid crystal display is showing moving pictures.

In order to resolve the common blurring phenomenon while the LCD is showing moving pictures, the related art often utilizes a method by inserting a black frame or shutting down the backlight unit at particular block of the display. Please refer to FIG. 1. FIG. 1 is a timing diagram showing the means of controlling a liquid crystal display 10 by inserting a black frame according to the prior art. As shown in FIG. 1, the liquid crystal display 10 includes a liquid crystal display panel 12 and a backlight unit 14. Ideally, the liquid crystal display panel 12 functions to control the rotation of the liquid crystal molecules for changing the transmittance of each pixel and producing the desired image corresponding to the image signal received. The backlight unit 14, on the other hand, includes a plurality of illumination devices 16 to generate light to illuminate the liquid crystal display panel 12 and enhance the brightness of the image produced by the liquid crystal display panel 12. In order to prevent the liquid crystal display 10 from producing the blurring phenomenon while displaying moving images, the conventional solution often involves inserting a black frame for every two frame periods. FIG. 1 shows the display status of the liquid crystal display 12 within four consecutive frame periods, in which each of the time intervals t2–t1, t3–t2, and t4–t3 includes a frame period, and the liquid crystal display 12 between time t1 and t3 includes a black frame.

Please refer to FIG. 2. FIG. 2 is a timing diagram showing the means of controlling the liquid crystal display 20 by turning off the backlight unit 24 periodically. In contrast to the insertion of a black frame from FIG. 1, the liquid crystal display 20 turns off the backlight unit 24 within two frame periods corresponding to time t1 and t3 thereby preventing the plurality of illumination devices 26 from illuminating during these two frame periods. Hence, the visual effect of the liquid crystal display 20 is essentially identical to the liquid crystal display 10 utilizing the black frame insertion method.

Additionally, N. Fisekovic et al. discloses an article "Improved Motion-Picture Quality of AM-LCDs Using Scanning Backlight" from the book "Asia Display/IDW '01". Please refer to FIG. 3. FIG. 3 is a status diagram showing another means of reducing the blurring phenomenon of moving images according to the prior art. As shown in FIG. 3, a liquid crystal display 30 includes a liquid crystal display panel 32 and a backlight unit 34, in which the backlight unit 34 further includes a plurality of illumination devices 36 to generate light and illuminate the liquid crystal display panel 32. Preferably, the liquid crystal display 30 reduces the visual blurring phenomenon by turning only one of the illumination devices 36 on within the same period. Please refer to FIG. 4 and FIG. 5. Disclosed in Fisekovic et al's article, FIG. 4 is a perspective diagram showing a liquid crystal display 40 and FIG. 5 is a timing diagram of the initiating time of each illumination device 46A to 46D and the corresponding gray scale of each pixel of the liquid crystal display 40 from FIG. 4. As shown in FIG. 4, the liquid crystal display 40 also includes a liquid crystal display panel 42 and a backlight unit 44, in which the backlight unit 44 includes a plurality of illumination devices 46A to 46D to generate light and illuminate the liquid crystal display panel 42. Similar to the backlight unit 34 of the liquid crystal display 30, only one of the illumination devices 46A to 46D of the backlight unit 44 will be turned on within the same period. FIG. 5 also illustrates four gray scale curves I, II, III, and IV of the pixels illuminated by the illumination devices 46A to 46D, in which each gray scale curve I to IV indicates a gray scale transformation of the corresponding pixel. For instance, curve I indicates the gray scale transformation of the pixels illuminated by the illumination device 46A within a time period T, and when the gray scale of the pixel undergoes a transformation, a delay phenomenon will result as the arrangement of the liquid crystal molecules will not be able to react in time. In order to prevent the gray scale transformation of the pixels before stabilization from being observed, each of the illumination devices 46A to 46D will be turned on after the liquid crystal direction of each of its corresponding pixels is stabilized. As shown in FIG. 5, each shadow represents the timing where each illumination device 46A to 46D is turned on, during which all of the gray scale of the corresponding pixels are transformed and stabilized. Nevertheless, the method ultimately brings out a disadvantage that since only one of the illumination device is turned on within the same period, the brightness of the liquid crystal display 40 will become insufficient and a larger electrical current will have to be applied on the illumination devices 46A to 46D to increase the brightness. However, increasing the electrical current also increases the necessity of making numerous measurements for performing safety precautions, providing a source of large electrical current for providing enough brightness, and providing a modified circuitry design for enhancing the fabrication process.

SUMMARY OF THE INVENTION

It is therefore an objective of the present invention to provide a method of controlling operations of the backlight unit of a liquid crystal display for reducing the blurring phenomenon.

According to the present invention, a method for controlling operations of a backlight unit of a liquid crystal display (LCD) is disclosed. The LCD includes a LCD panel and the backlight unit. The LCD panel has a plurality of display units. The backlight unit is placed behind the LCD panel and has a plurality of illumination devices for providing light to the LCD panel. The method includes: (a) keeping at least two of the illumination devices turned on at all times; (b) turning off one of the illumination devices every predetermined time interval; and (c) turning on one of the illumination devices every predetermined time interval.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
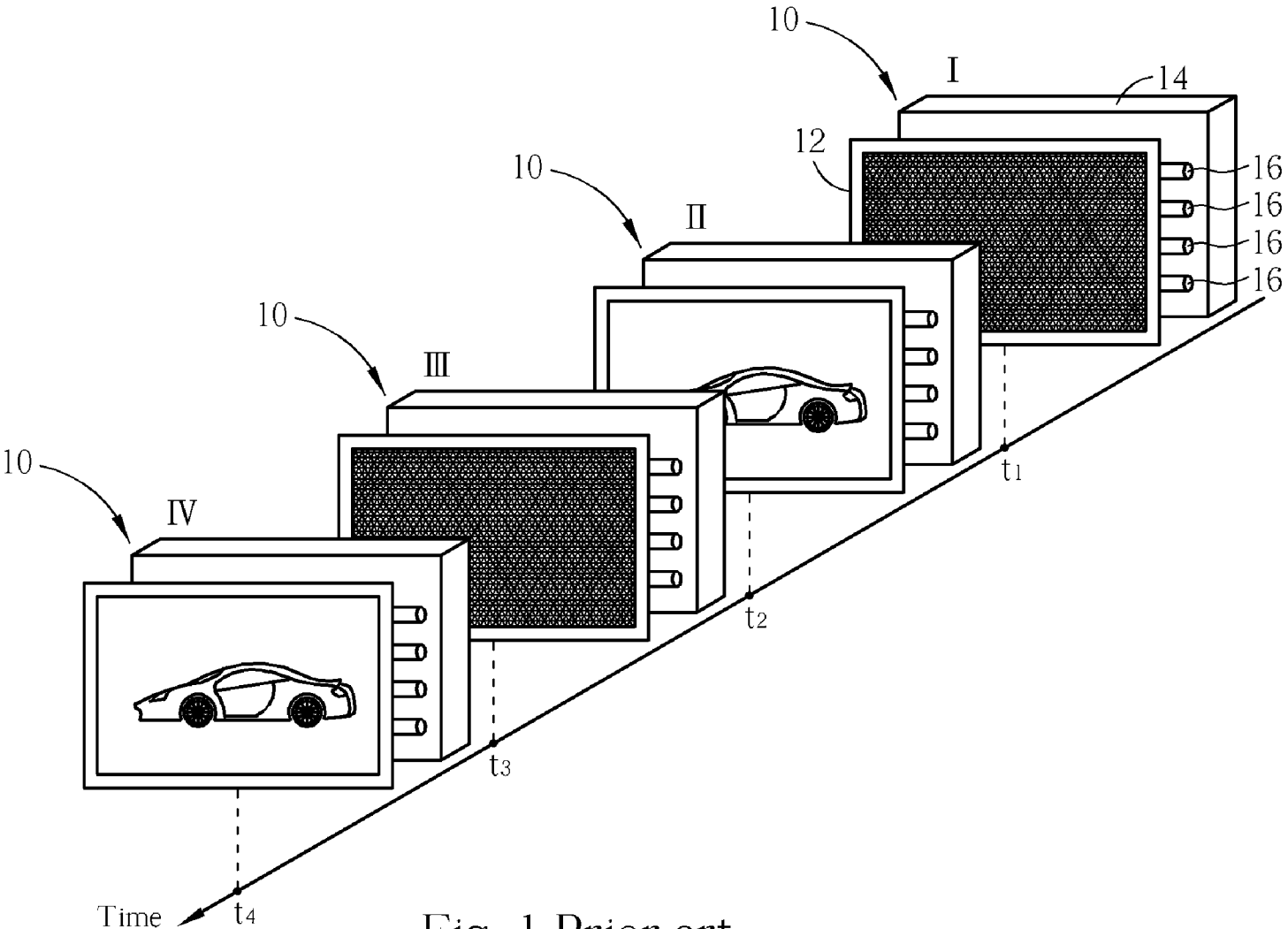
Fig. 1 Prior art
FIG. 1 is a timing diagram showing the means of controlling a liquid crystal display by inserting a black frame according to the prior art.
Figure 2:
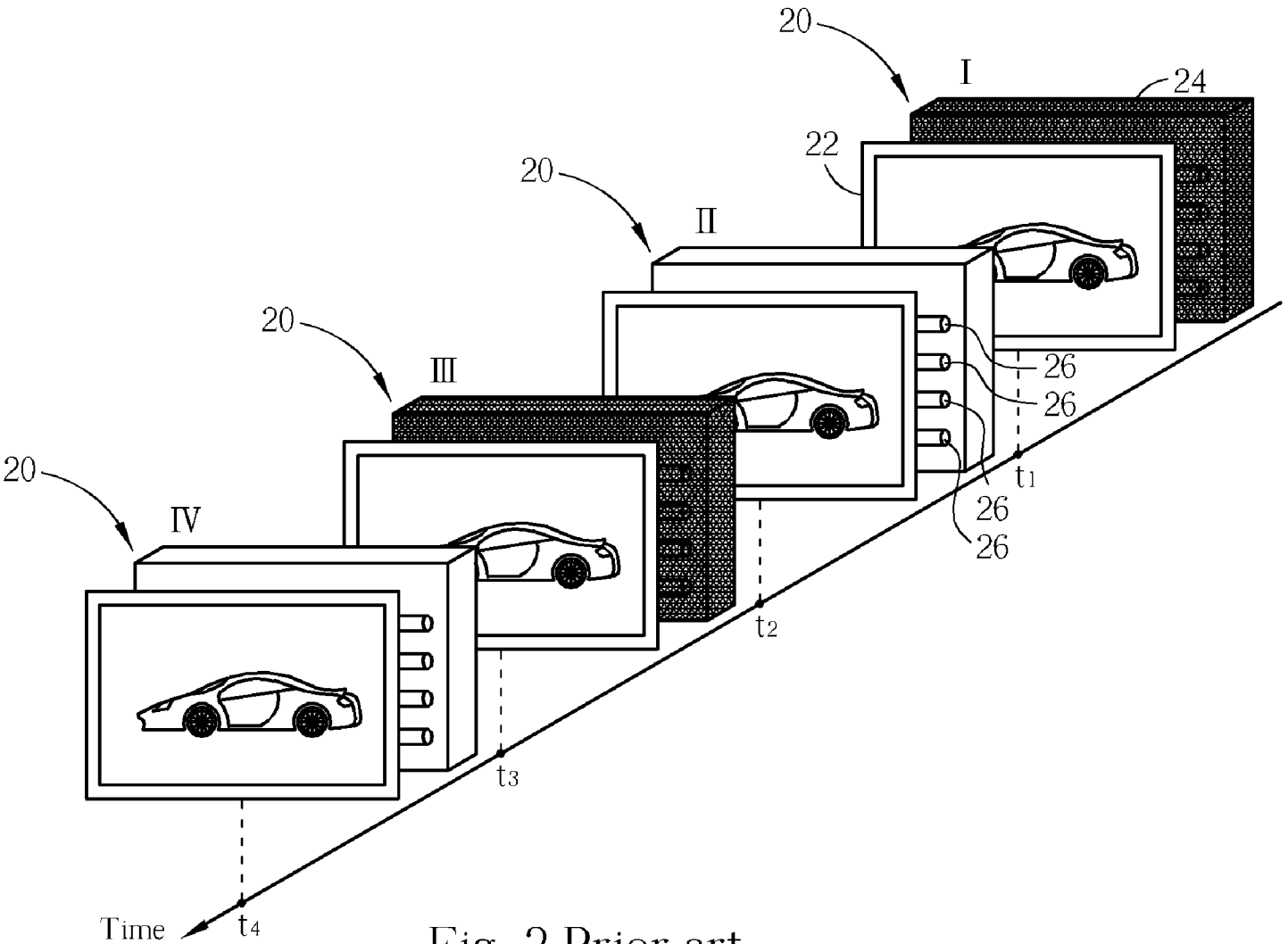
Fig. 2 Prior art
FIG. 2 is a timing diagram showing the means of controlling a liquid crystal display by turning off the backlight unit periodically according to the prior art.
Figure 3:
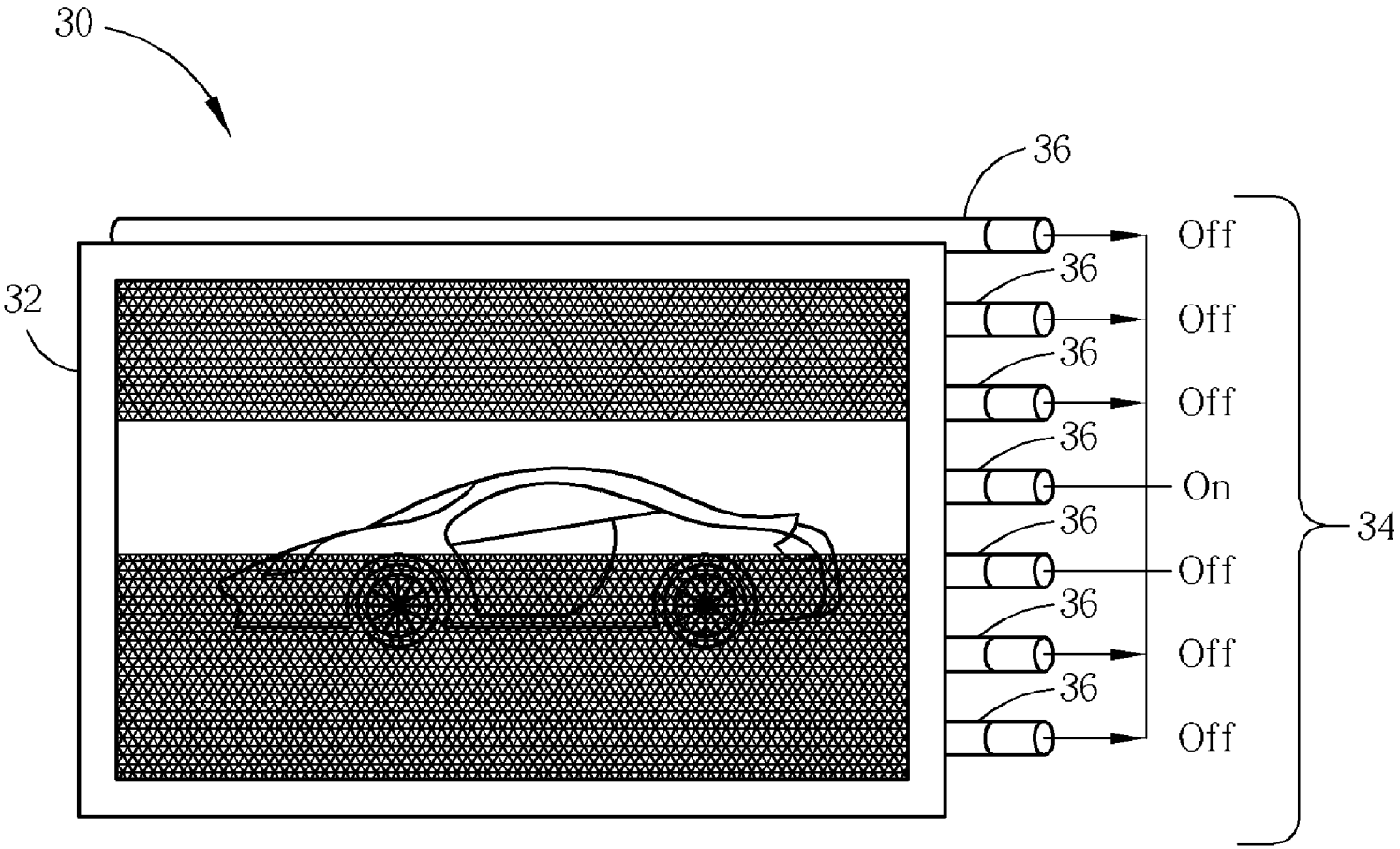
Fig. 3 Prior art
FIG. 3 is a status diagram showing another means of reducing the blurring phenomenon of moving images according to the prior art.
Figure 4:
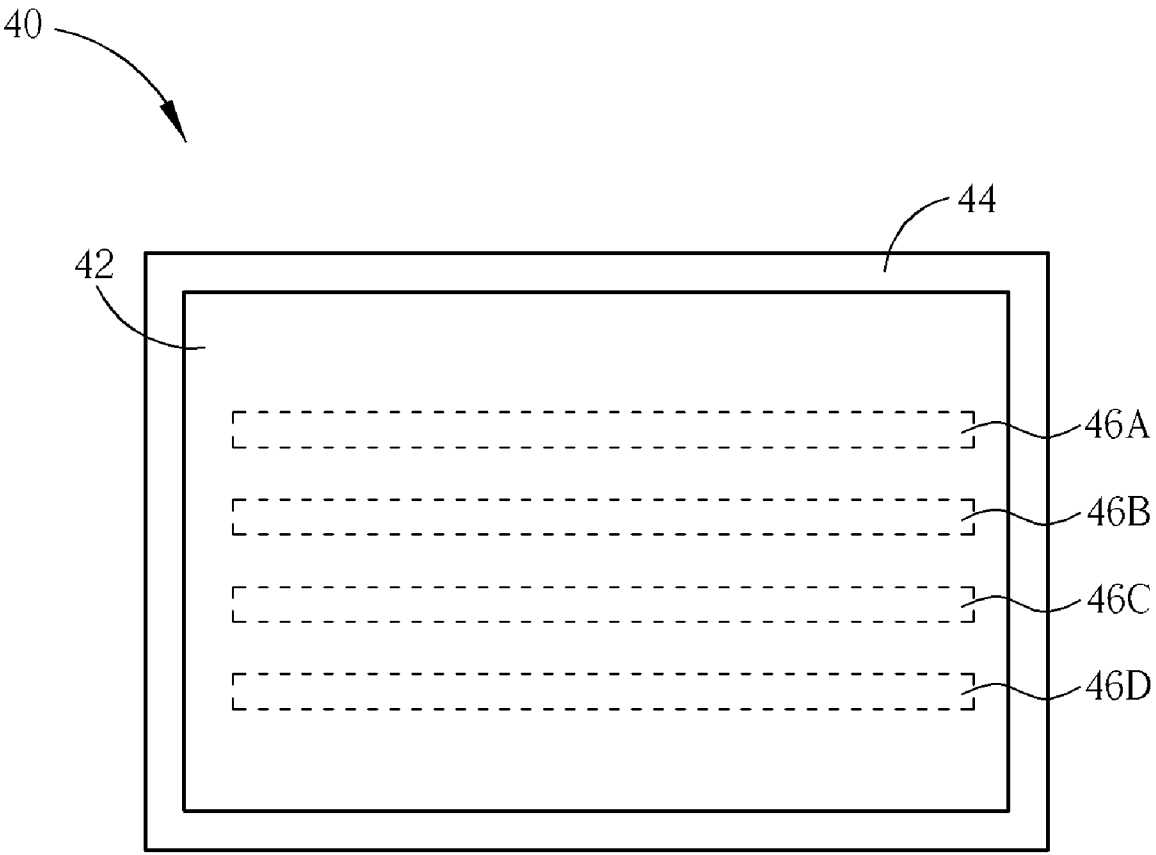
Fig. 4 Prior art
FIG. 4 is a perspective diagram showing another liquid crystal display according to the prior art.
Figure 5:
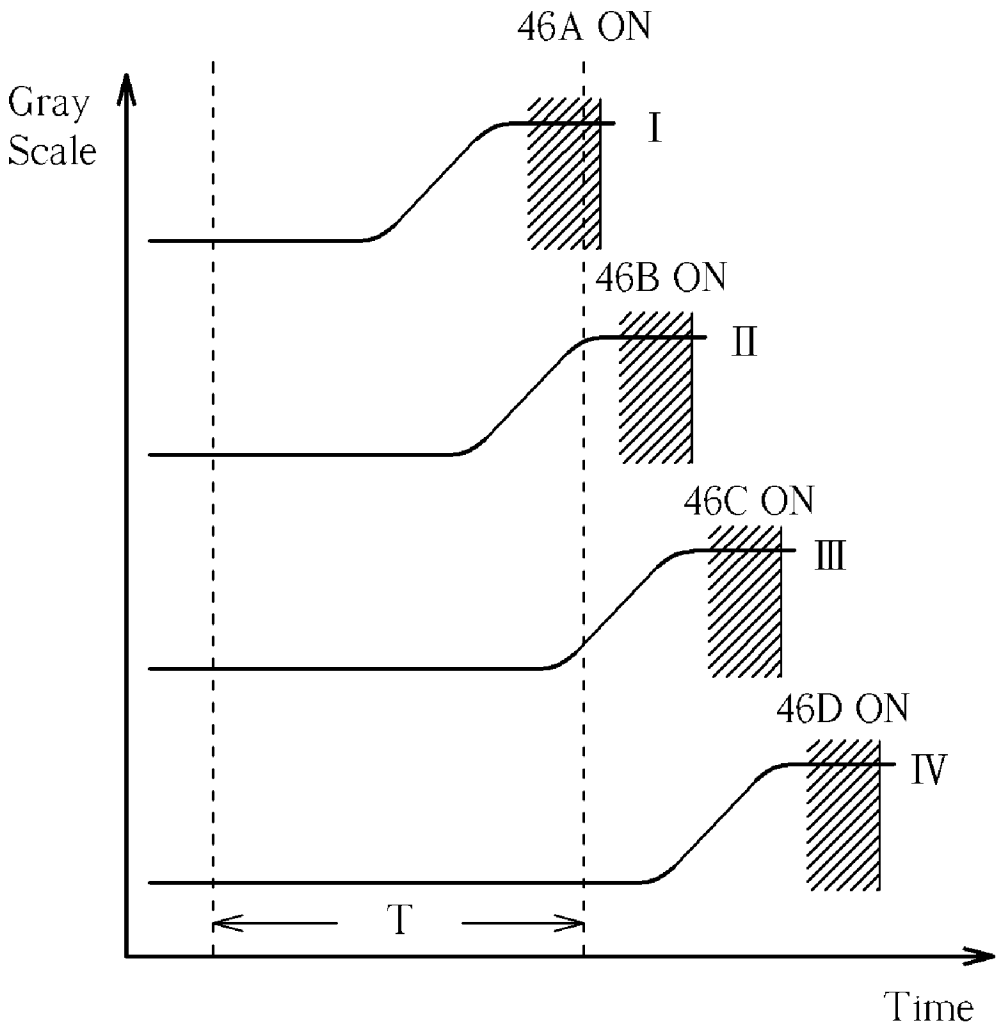
Fig. 5 Prior art
FIG. 5 is a timing diagram of the initiating time of each illumination device and the corresponding gray scale of each pixel of the liquid crystal display from FIG. 4.
Figure 6:
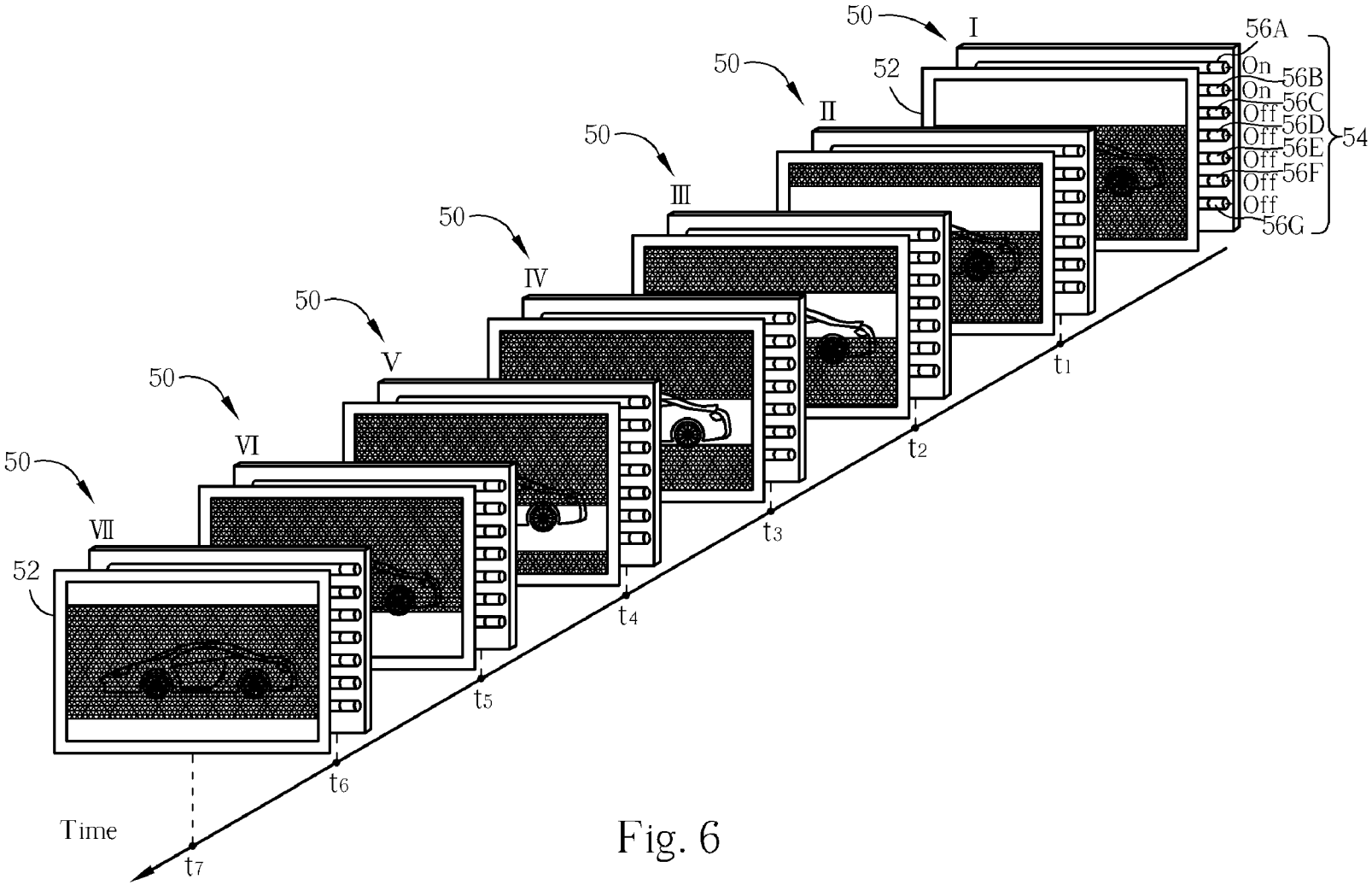
FIG. 6 is a timing diagram showing the means of controlling operations of the backlight unit of a liquid crystal display according to the present invention.
Figure 7:
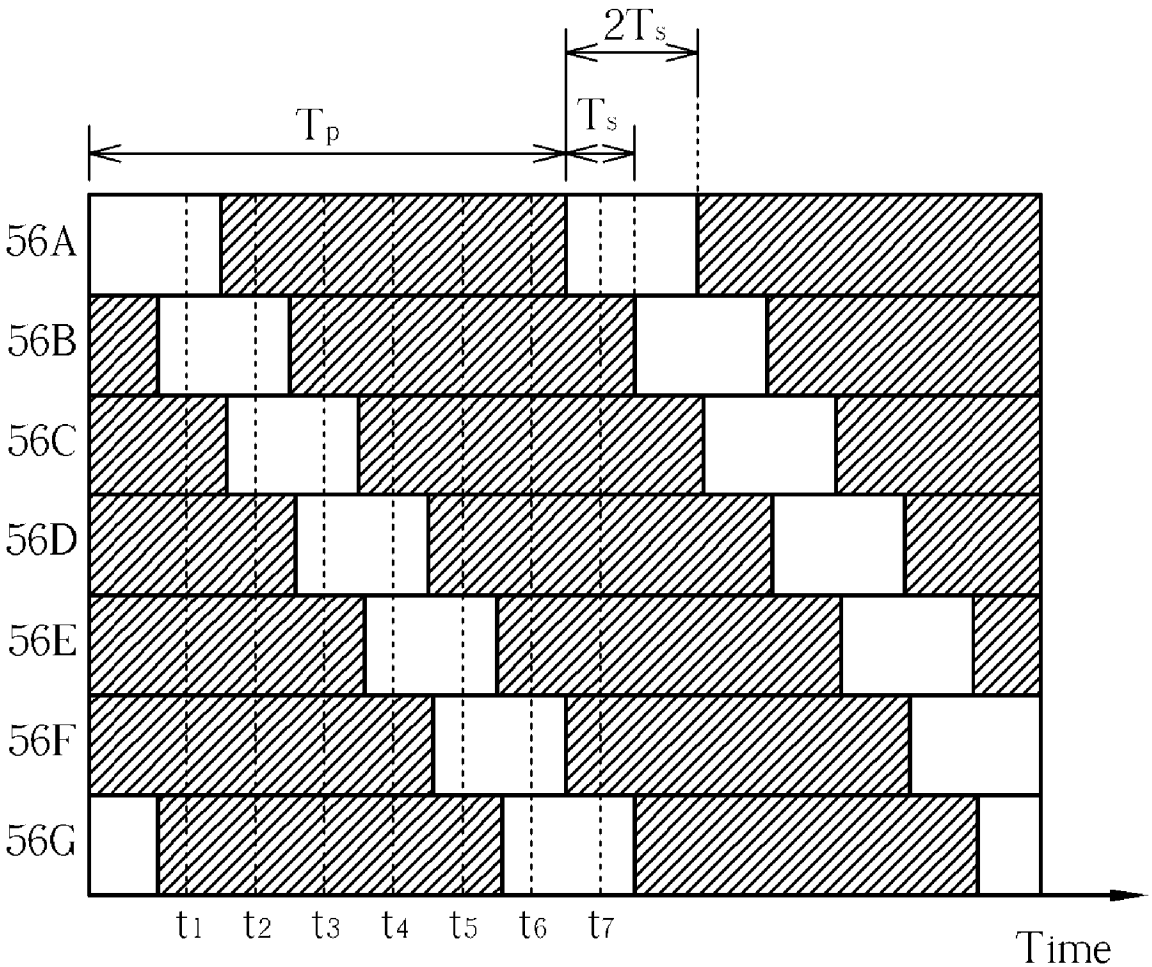
FIG. 7 is a timing diagram during the operation of the plurality of illumination devices of the backlight unit from FIG. 6.

Please refer to FIG. 6 and FIG. 7. FIG. 6 is a timing diagram showing the means of controlling operations of the backlight unit 54 of a liquid crystal display 50 according to the present invention and FIG. 7 is a timing diagram showing the operation of the plurality of illumination devices of the backlight unit from FIG. 6. First of all, for the seven time points t1, t2, t3, t4, t5, t6, and t7 on the time axis, the time differences between each two adjacent time points are equivalent to each other, hence t2−t1=t3−t2=t4−t3=t5−t4=t6−t5=t7−t6. The liquid crystal display 50 includes a liquid crystal display panel 52 and a backlight unit 54, in which the backlight unit 54 includes a plurality of illumination devices 56A to 56G to provide light to the liquid crystal display panel 52. Preferably, the liquid crystal display panel 52 is able to control the light transmittance of the display units according to the received signals for generating corresponding images. In order to prevent the blurring phenomenon while moving images are displayed, the liquid crystal display 50 will consecutively turn the illumination devices 56A to 56G on to keep at least two of the illumination devices 56A to 56G on at any time and at least one of the illumination devices 56A to 56G off. Preferably, the illumination devices 56A to 56G are turned on from top to bottom accordingly and while one of the illumination devices 56A to 56G is turned on, another one of the illumination devices 56A to 56G is turned off. Hence, in contrast to the conventional method of turning all of the illumination devices on at the same time or turning only one of the illumination devices on within the same period, the present invention is able to provide a method of turning at least two illumination devices 56A to 56G on within a time interval for illuminating the backlight unit 54.

Preferably, the number of illumination devices 56A to 56G of the backlight unit 54 is not limited to seven, as discussed previously. Moreover, the number of illumination devices 56A to 56G being turned on at the same time is not limited to two, but can also be other numbers greater than two, such as three, four, etc.

As shown in FIG. 7, $T_p$ and $T_s$ each represents the frame period of the liquid crystal display panel 52 frame refreshment and the time interval between two adjacent time points t1, t2, t3, t4, t5, t6, or t7, such that the time difference between two adjacent time of the seven time points t1, t2, t3, t4, t5, t6, and t7 is equivalent to each other. During each elapsed time interval Ts, one of the illumination devices 56A to 56G will be turned on and at the same time, another one of the illumination devices 56A to 56G will be turned off. Since at least two of the illumination devices 56A to 56G will be turned on at any time, the initiating time of each illumination device 56A to 56G will equal to $2T_s$, and $T_p=7T_s$. Nevertheless, the total number of the illumination device may not equal to seven and the number of illumination devices being turned on within the same time may also be greater than two. Suppose the number of illumination devices of the backlight unit of a liquid crystal display equals A, the number of illumination devices being turned on at the same time equals B, an illumination device will be turned on during each elapsed time interval $T_s'$, and the frame period of the liquid crystal display panel still equals $T_p$. In this case, $T_p=AT_s'$ and the period of time within which every illumination device is turned on will equal to $BT_s'$. Hence, the ratio of the period of time $BT_s'$ within which every illumination device is turned on and the frame period $T_p$ of the liquid crystal display panel will equal to B/A, in which B/A ranges from 0.01 to 0.8. Additionally, the inverse of the frame period $T_p$ is in fact the refreshing frequency of the liquid crystal display panel 52, in which the refreshing frequency typically utilized in liquid crystal display panels ranges from 24 Hz to 600 Hz. Nevertheless, the method of the present invention is also applicable to other refreshing frequencies commonly used today.

Figure 8:
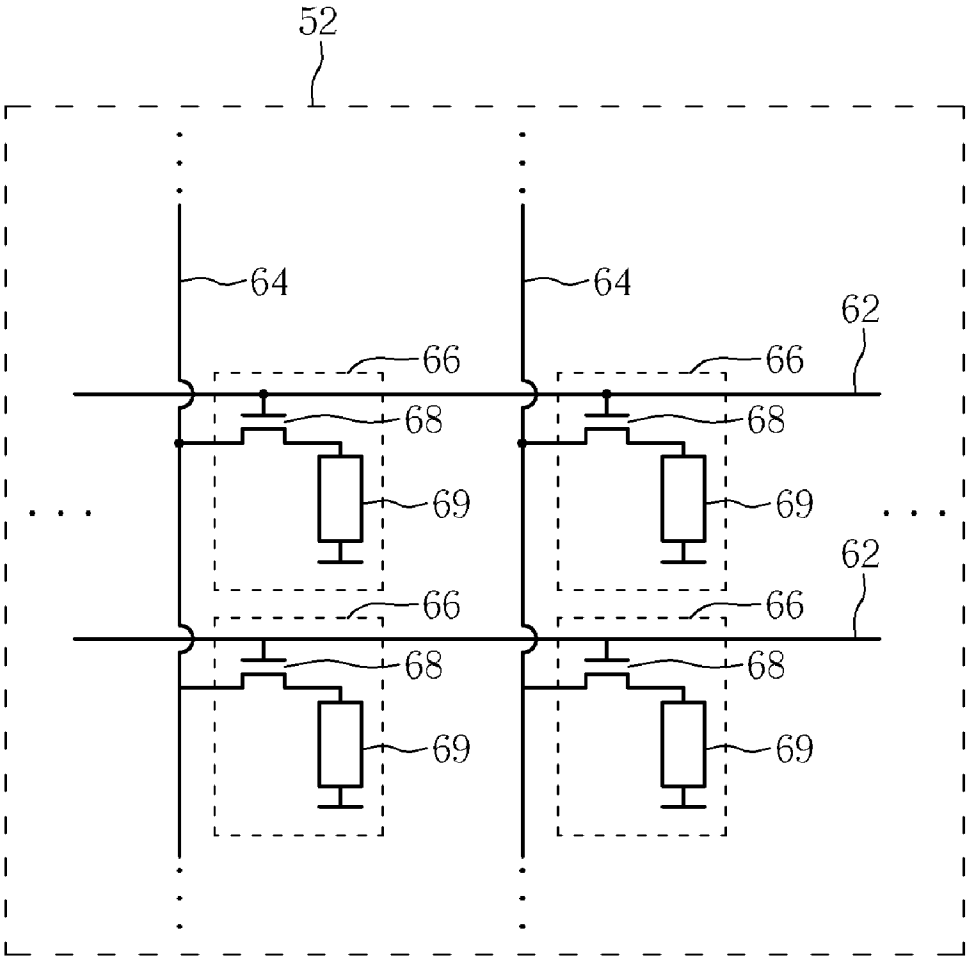
FIG. 8 is a circuit diagram of the liquid crystal display panel from FIG. 6.

Please refer to FIG. 8. FIG. 8 is a circuit diagram of the liquid crystal display panel 52 from FIG. 6. As shown in FIG. 8, the liquid crystal display panel 52 includes a plurality of scan lines 62, a plurality of data lines 64, and a plurality of display units 66, in which each of the display units 66 is connected to a corresponding scan line 62 and a corresponding data line 64, and each display unit 66 also includes a switch device 68 and a liquid crystal device 69. The display units 66 of the liquid crystal display panel 52 are arranged into a matrix, in which each column of the display units 66 is connected to a corresponding data line 64 and each row of the display units 66 is connected to a corresponding scan line 62. Corresponding to at least one row of display units 66 from FIG. 8, each illumination device 56A to 56G from FIG. 6 functions to illuminate each corresponding row of display units 66 at the appropriate time. Preferably, when the frame of the liquid crystal display 52 is refreshed, a high voltage will be applied to each scan line 62 from top to bottom accordingly to turn on the switch device 68 connected to the corresponding row of display units 66.

After the switch device 68 is turned on, a voltage will be applied to each corresponding data line 64, such that the liquid crystal device 69 of the display unit 66 connected to the scan line 62 for which the voltage is received will generate a rotation and display a corresponding gray scale. Since a delay phenomenon often results after the rotation of the liquid crystal device 69, the initiating time of each illumination device 56A to 56G has to be accurately controlled to generate a satisfactory image. For instance, suppose that the display units 66 of the liquid crystal display panel 52 are arranged in 100 rows and each illumination device 56A to 56G is aligned with corresponding display units 66 from the 100 rows. In order to provide a satisfactory image, the switch devices 68 from the 100 rows should be turned on to cause the connected liquid crystal device 69 to generate a rotation during each elapsed time interval $T_s$. After the switch devices 68 are turned on, the corresponding illumination devices 56A to 56G will wait for the gray scale displayed by the liquid crystal device 69 to be stabilized for a predetermined time, such that when each illumination device 56A to 56G is turned on, the gray scale of each display unit 66 illuminated by the illumination device 56A to 56G is guaranteed to be stabilized.

Preferably, each illumination device 56A to 56G can be a cold cathode fluorescent lamp (CCFL), external electrode fluorescent lamp (EEFL), light emitting diode (LED), plasma display panel (PDP), or organic light-emitting diode (OLED) for providing light to the LCD panel 52, such that when an illumination device 56A to 56G is turned on, a current usually greater than 1 mA flowing through the illumination device will provide enough light source to the LCD panel 52.

Figure 9:
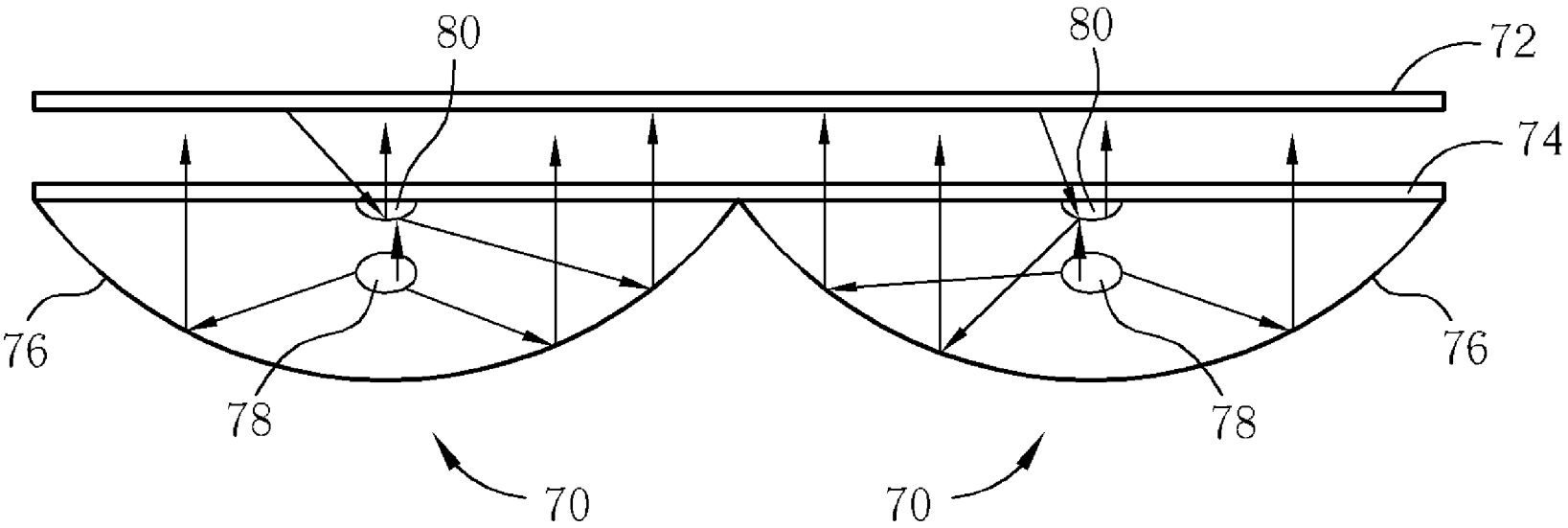
FIG. 9 is a perspective diagram showing an illumination device having two wave-shaped reflecting sheet according to the present invention.

In order to increase the efficiency of the illumination device of the backlight unit, the illumination device may also includes a reflecting sheet to increase the intensity of the light projecting to the LCD panel, such that the reflecting sheet can be flat, wave-shaped, or hill-shaped. Please refer to FIG. 9. FIG. 9 is a perspective diagram showing the illumination device 70 having two wave-shaped reflecting sheets according to the present invention. As shown in FIG. 9, each illumination device 70 includes a lamp 78, a wave-shaped reflecting sheet 76, and a reflecting body 80. Preferably, the reflecting sheet 76 is utilized to reflect light generated by the lamp 78, in which a transparent acrylic plate 74 and a diffusing plate 72 are disposed on the reflecting sheet 76, and the reflecting body 80 is disposed over the bottom surface of the transparent acrylic plate 74 to reflect the light generated by the lamp 78. The diffusing plate functions to diffuse the light from the lamp 78, the reflecting sheet 76, and the reflecting body 80, thereby averaging the light intensity generated on the upper surface of the diffusing plate 72. Additionally, the fluorescent body used by the lamp 78 can be a typical [(Sr,Ca,Ba)5($PO_4$)3Cl:Eu, BaMg2Al16O27:Eu,LaPO4:Ce,Tb,Y2O3:Eu] fluorescent body or a [(Sr,Mg)3($PO_4$)2:Sn,Y3(Al,Ga)5O12:Ce] fluorescent body having faster light reaction, and the electrode can be a typical nickel (Ni) electrode or electrodes having longer life expectancy, such as molybdenum (Mo) or niobium (Nb) electrodes.

In contrast to the conventional method of reducing blurring of moving images, the present invention utilizes a novel method to control operations of the backlight unit of a liquid crystal display. Preferably, at least two illumination devices of the backlight unit are turned on at any time and at least one illumination device is turned off. By keeping an equal surface illumination of the LCD display, the electrical current that passes through each illumination device will be less than the electrical current when only one illumination device is turned on.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for controlling operations of a backlight unit of a liquid crystal display, wherein the liquid crystal display comprises a liquid crystal display panel having a plurality of display units; and a backlight unit disposed behind the liquid crystal display panel, wherein the backlight unit further comprises a plurality of illumination devices and each of the illumination devices is capable of providing light to the liquid crystal display panel; the method comprising:

keeping at least two of the illumination devices turned on at any time;

turning one of the illumination devices off during every predetermined time interval; and turning one of the illumination devices on during every predetermined time interval.

2. The method of claim 1 further comprising:

keeping at least one of the illumination devices turned off at any time.

3. The method of claim 1 further comprising:

keeping a predetermined number the illumination devices turned on at any time.

4. The method of claim 1, wherein the display units are arranged into a matrix, each column of the display units is connected to a corresponding data line, each row of the display units is connected to a corresponding scan line, each illumination device is corresponding to at least one row of display units, and each display unit comprises a switch device and a liquid crystal device, and the method further comprises:

utilizing the scan line to turn the switch device of at least one row of display units on during every predetermined time interval; and turning the illumination device corresponding to the row of display units on within a predetermined time interval after the switch device of each row of display units is turned on.

5. The method of claim 1, wherein the refreshing frequency of the liquid crystal display panel ranges from 24 Hz to 600 Hz.

6. The method of claim 1, wherein the ratio between the period of time of each illumination device is turned on and the frame period of the liquid crystal display panel at any time ranges from 0.01 to 0.8.

7. The method of claim 1, wherein the electrical current flowing through an illumination device when the illumination device is turned on is greater than 1 mA.

8. The method of claim 1, wherein each of the illumination devices comprises a lamp.

9. The method of claim 8, wherein the fluorescent body of the lamp is [(Sr,Ca,Ba)5(PO4)3Cl:Eu,BaMg2Al16O27:Eu, LaPO4:Ce,Tb,Y2O3:Eu].

10. The method of claim 8, wherein the fluorescent body of the lamp is [(Sr,Mg)3(PO4)2:Sn,Y3(Al,Ga)5O12:Ce].

11. The method of claim 8, wherein the electrodes of the lamp are nickel (Ni) electrodes.

12. The method of claim 8, wherein the electrodes of the lamp are molybdenum (Mo) electrodes.

13. The method of claim 8, wherein the electrodes of the lamp are niobium (Nb) electrodes.

14. The method of claim 1, wherein the illumination device is selected from the group consisting of a cold cathode fluorescent lamp (CCFL), an external electrode fluorescent lamp (EEFL), a light emitting diode LED), a plasma display panel (PDP), and an organic light-emitting diode (OLED).

15. The method of claim 1, wherein each of the illumination devices further comprises a reflecting sheet for reflecting the light generated by the illumination device.

* * * * *